US005752325A

United States Patent [19]

Kotitschke

[11] Patent Number: 5,752,325

[45] Date of Patent: May 19, 1998

[54] DRIER SECTION FOR DRYING A CONTINUOUS WEB

[75] Inventor: Gerhard Kotitschke, Steinheim, Germany

[73] Assignee: Voith Sulzer Papiermaschinen GmbH, Heidenheim, Germany

[21] Appl. No.: 751,327

[22] Filed: Nov. 18, 1996

[30] Foreign Application Priority Data

Nov. 18, 1995 [DE] Germany ..... 195 43 086.7

[51] Int. Cl.[6] ..... D21F 5/00

[52] U.S. Cl. ..... 34/117; 34/117

[58] Field of Search ..... 34/453, 454, 459, 34/116, 117, 118, 120

[56] References Cited

U.S. PATENT DOCUMENTS

| | | | |
|---|---|---|---|
| 4,378,639 | 4/1983 | Walker | 34/116 X |
| 4,427,736 | 1/1984 | Beacom et al. | 34/116 X |
| 4,510,698 | 4/1985 | Ely | 34/117 |
| 5,539,999 | 7/1996 | Kuhasalo | 34/117 X |
| 5,555,638 | 9/1996 | Lehosvuo et al. | 34/117 |

FOREIGN PATENT DOCUMENTS

95/21293 8/1995 WIPO .

OTHER PUBLICATIONS

Haessner, "Trocknungstechnik und deren Entwicklung," Das Papier, vol. 4, No. 10A, pp. V155–163 (1990).

A German Office Action dated Aug. 22, 1996.

*Primary Examiner*—Henry A. Bennett
*Assistant Examiner*—Steve Gravini
*Attorney, Agent, or Firm*—Greenblum & Bernstein P.L.C.

[57] ABSTRACT

A drier section for drying a continuous web, particularly a paper web produced by a paper manufacturing machine. The drier section may include at least one single-row drier group with a plurality of drier cylinders and a plurality of guide rollers. The continuous web may guided, together with a continuous felt, in a meandering manner through the drier section. The drier section may also include a plurality of additional drier cylinders and a separate felt guided by additional guide rollers for guiding the continuous web around the drier cylinders of the single-row drier group and around the additional drier cylinders. The number of the additional drier cylinders may be less than the number of drier cylinders disposed within the single-row drier group.

30 Claims, 2 Drawing Sheets

DRIER SECTION FOR DRYING A CONTINUOUS WEB

CROSS-REFERENCE OF RELATED APPLICATIONS

The present invention claims the priority under 35 U.S.C. § 119 of German Patent Application No. 195 43 086.7 filed on Nov. 18, 1995, the disclosure of which is expressly incorporated by reference herein in its entirety.

BACKGROUND OF THE INVENTION

1. Field of the Invention

The present invention relates to a drier section for the drying of a continuous web, and in particular, a paper web produced by a paper manufacturing machine. The drier section may include a single row drier group including a plurality of drier cylinders and guide rollers around which the continuous web may be guided with a continuous felt belt.

2. Discussion of the Background Information

Drier sections are known which include at least one single-row drier groups to which at least one double-row drier group is series connected. Such a structure is preferred in order to minimize the curl of the paper on each web surface. This effect is referred to as curl control. The use of single- and double-row drier groups, however, requires relatively high costs for construction and maintenance.

SUMMARY OF THE INVENTION

It is an object of the present invention to create a drier section which does not suffer this disadvantage.

To solve this problem, a drier section may include at least one single-row drier group including a plurality of drier cylinders and a plurality of guide rollers around which a continuous web is concurrently guided with a continuous felt belt. The drier section may include a plurality of additional drier cylinders utilizing a separate felt belt guided by a plurality of additional guide rollers. The plurality of additional drier cylinders and the plurality of additional guide rollers may be positioned to guide the continuous web in a meandering manner around the drier cylinders of the single-row drier group and around the plurality of additional drier cylinders. The drier section may utilize fewer additional drier cylinders than the number of drier cylinder utilized in the single-row drier group.

The plurality of additional drier cylinders may be connected to the drier cylinders of the single-row drier group so that the continuous web to be dried can be guided around both the drier cylinders of the single-row drier group and the additional drier cylinders in a single meandering path through the drier section. Because the number of additional drier cylinders utilized within the drier section may be less than number of drier cylinders within the single-row group, only a relatively simple setting may be necessary to integrate the additional drier cylinders into the paper machine, or, more specifically, the drier section. Further, drier sections in which at least one to four additional drier cylinders with their own felt have been utilized have proven particularly useful in curl control. Thus, a drier section constructed in the manner discussed herein permits a very good reduction of the washboard marks of the continuous web to be dried without the need for a double-row (i.e., a double felt) drier group.

In accordance with another feature of the present invention, the plurality of additional drier cylinders may include between one and four drier cylinders.

In accordance with yet another feature of the present invention, the plurality of additional drier cylinders may include one or two drier cylinders less than the plurality of drier cylinders.

In accordance with still another feature of the present invention, the plurality of additional drier cylinders may include a diameter less than a diameter of the plurality of drier cylinders.

In accordance with a further feature of the present invention, a portion of the plurality of drier cylinders arranged adjacent to the plurality of additional drier cylinders may include a diameter less than the diameter of a remaining portion of the plurality of drier cylinders.

In accordance with a still further feature of the present invention, the diameter of the portion of drier cylinders may be substantially similar to a diameter of the plurality of additional drier cylinders.

In accordance with another feature of the present invention, a portion of the plurality of guide rollers may be arranged adjacent to the plurality of additional drier cylinders, and the portion of guide rollers may be arranged parallel to the plurality of drier cylinders.

In accordance with a further feature of the present invention, the plurality of additional drier cylinders may be positioned within one of a center area and an end section, with respect to a transport direction of the continuous web, of the single-row drier group.

In accordance with still another feature of the present invention the continuous felt belt may be guided around the plurality of drier cylinders and around the plurality of additional drier cylinders.

In accordance with yet another feature of the present invention, the device may include at least two additional drier cylinder groups in which each of the at least two additional drier cylinder groups include a separate felt.

In accordance with still another feature of the present invention, the at least two additional drier cylinder groups may be associated with two adjacent single-row drier groups and positioned within a border area between the two adjacent single-row drier groups.

In accordance with a still further feature of the present invention, the single-row drier group may include upper drier cylinders.

In accordance with a still further feature of the present invention, the single-row drier group may include lower drier cylinders.

In accordance with yet another feature of the present invention, the device may include a plurality of single-row drier groups in which at least one of the single-row drier groups may include a plurality of additional drier cylinders.

In accordance with another feature of the present invention, the single-row drier group may include the additional drier cylinders positioned at one of a center and an end, with respect to a transport direction of the web, of the plurality of single-row drier groups.

In accordance with a further feature of the present invention, the continuous web may include a paper web produced by a paper manufacturing machine.

In accordance with yet another feature of the present invention, the plurality of additional drier cylinders may include one of two and three drier cylinders.

The present invention may also be directed to a drier section for drying a continuous web. The drier section may include a plurality of first drier cylinders colinearly arranged and a plurality of second drier cylinders colinearly arranged. The plurality of first drier cylinders and the plurality of second drier cylinders may be parallely arranged. The drier section may also include a plurality of guide rollers for guiding the continuous web around each drier cylinder in the first and the second plurality of drier cylinders.

In accordance with another feature of the present invention, the plurality of guide rollers may include a first set of guide rollers associated with the plurality of first drier cylinders and a second set of guide rollers associated with the plurality of second drier cylinders.

In accordance with yet another feature of the present invention, the device may include a first continuous felt member arranged around each of the plurality of first drier cylinders and around each of the first set of guide rollers. The device may also include a second continuous felt member arranged around each of the plurality of second drier cylinders and around each of the second set of guide rollers.

In accordance with a still further feature of the present invention, the device may include a continuous felt member arranged around each of the plurality of first drier cylinders and around each of the plurality of second drier cylinders.

In accordance with still another feature of the present invention, the plurality of second drier cylinders may be positioned adjacent an approximate middle portion of the plurality of first drier cylinders.

In accordance with still another feature of the present invention, the plurality of second drier cylinders may be positioned adjacent an end portion, with respect to a transport direction of the continuous web, of the plurality of first drier cylinders.

In accordance with another feature of the present invention, each of the plurality of first drier cylinders may include a first diameter and each of the plurality of second drier cylinders may include a second diameter. The first diameter may be greater than the second diameter.

In accordance with still another feature of the present invention, the plurality of first drier cylinders may include an adjacent portion positioned adjacent to the plurality of second drier cylinders and a remaining portion including the first drier cylinders not positioned adjacent to the plurality of second drier cylinders.

In accordance with a further feature of the present invention, the first drier cylinders of the adjacent portion may include a first diameter and the first drier cylinders of the remaining portion may include a second diameter. The first diameter may be less than the second diameter.

In accordance with a still further feature of the present invention, the plurality of second drier cylinders may include a third diameter. The third diameter may be substantially similar to the first diameter.

In accordance with yet another feature of the present invention, a total of the plurality of second drier cylinders may be less than a total of the plurality of first drier cylinders.

In accordance with still another feature of the present invention, the first set of guide rollers may include an adjacent guide portion positioned adjacent the plurality of second drier cylinders and a remaining guide portion may include the first set of guide rollers not adjacent to the second drier cylinders.

In accordance with yet another feature of the present invention, the guide rollers of the remaining guide portion may be colinearly arranged parallel to the plurality of first drier cylinders.

In accordance with a further feature of the present invention, at least one of the guide rollers of the second set of guide rollers may be colinearly arranged with the plurality of second drier cylinders.

In accordance with a preferred embodiment of the drier section of the present invention, the additional drier cylinders may have a smaller diameter than the drier cylinders of the single-row drier section. Curl control may be quite effective when the diameters of the additional drier cylinders are smaller than the diameters of cylinders utilized in the single-row drier group. The reduced size of the additional cylinders correspondingly reduces the total space necessary for housing the drier section. Thus, the arrangement enables a relatively cost effective implementation.

Also in accordance with the preferred embodiment of the drier section of the present invention, certain individual drier cylinders of the single-row drier group may have a smaller diameter smaller than other remaining cylinders of the single-row drier group. These smaller drier cylinders may be connected to additional drier cylinders through the continuous web to minimize the space required to house the drier section with the addition of the additional driers.

An alternative preferred embodiment of the drier section of the present invention, may include additional drier cylinders arranged at an end section of the single-row drier group. With this arrangement, it is contemplated that the guide rollers which cooperate with the additional drier cylinders may be symmetrically arranged, i.e., a first and a last guide roller utilized with the additional drier cylinders may be colinearly arranged with the additional drier cylinders. Further, the guide rollers and the additional drier cylinders may also be arranged substantially parallel to the drier cylinders of the single-row drier group. Thus, this arrangement results in a simple construction that may also be realized in a cost effective manner.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

Figure 1:
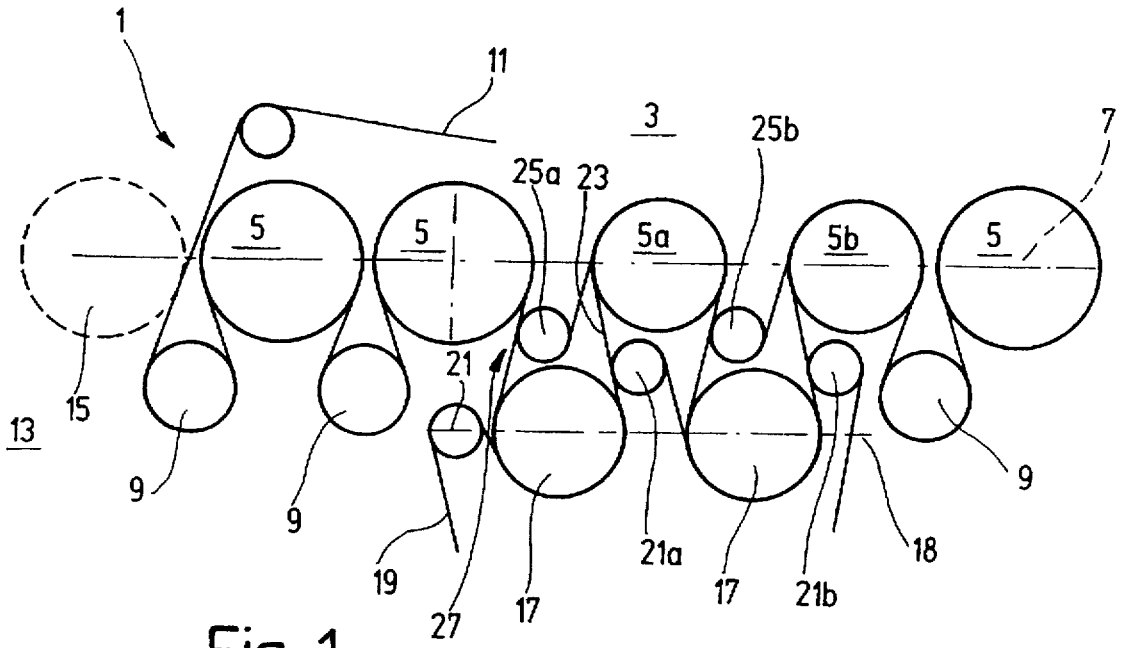
FIG. 1 shows a side view of an exemplary embodiment of a drier section according to the present invention.

A schematic side view of a first exemplary embodiment of the present invention is shown in FIG. 1. A drier section 1 is shown including a drier group 3. Drier group 3 may include several drier cylinders 5 adjacently positioned such that the center axis of each drier cylinder 5 may be arranged to form an imaginary line 7. Arranged below the drier cylinders 5, the drier group may include guide rollers 9. Guide rollers 9 may also be arranged such that each of their center axes is arranged to form an imaginary line (not shown) parallel to imaginary line 7. Drier cylinders 5 and the guide rollers 9 may be looped, or joined, by a transport band, e.g, a felt belt 11, which loops around the drier cylinders 5 and the guide rollers 9 in a meandering manner. The drier group 3 may continue to the right of FIG. 1 (not shown).

Also, preceding drier group 3 may be another drier group, e.g., drier group 13. It is noted that drier group 13 is represented in FIG. 1 by the a final drier cylinder of the preceding group, i.e., drier cylinder 15 (shown in a broken line). The center axes of both the preceding and subsequent drier group(s) are also positioned along imaginary line 7. Accordingly, the drier section of FIG. 1 forms a single-row, single (or top) felt drier section in which each of the drier groups may include its own felt 11. Felt 11 may also be referred to as a top felt.

Arranged near a center section of drier group 3, FIG. 1 shows an additional group including two additional drier cylinders 17 positioned for coordination with drier group 3. The center axes of additional cylinders 17 may form an imaginary line 18 which is parallel to imaginary line 7. Further, additional cylinders 17 may be looped by a separate felt 19. Felt 19 may be deflected by suitable additional guide rollers 21, 21*a*, and 21*b* so that the felt 19 loops around additional guide rollers 21, 21*a*, and 21*b* and additional drier cylinders 17 in a meandering manner. Guide rollers 21*a* and 21*b*, which follow guide roller 21 in the transport direction of the web 23 may be positioned to have a lesser distance to imaginary line 7 than the distance from guide roller 21 to imaginary line 7. Within the near center section of drier group 3, i.e., the additional drier section, guide rollers 9 may be replaced with smaller guide rollers 25*a* and 25*b*, whose center axes may form an imaginary line (not shown) parallel to imaginary line 7 and may be located closer to imaginary line 7 than the center axes of guide rollers 9.

Also within the additional drier section of drier group 3, drier cylinders 5*a* and 5*b* may have a smaller diameter than the drier cylinders 5 of drier group 3. The diameter of the drier cylinders 5*a* and 5*b* may approximately correspond to the diameter of additional drier cylinders 17. Thus, it may be contemplated from this embodiment of the present invention that drier cylinders 5*a* and 5*b* may be interchangeable with additional drier cylinders 17. This interchangeability feature may contribute to a reduction in manufacturing costs for drier section 1.

Web 23, to be dried in accordance with the present invention, runs through drier group 3 with felt 11 in a meandering manner around the guide rollers 9 and around drier cylinders 5. Near the center section of drier group 3, i.e., at the additional cylinder section, web 23 may be conveyed from, e.g., the second drier cylinder 5 to the first additional drier cylinder 17. When the web is conveyed from the second drier cylinder 5 to the first additional drier cylinder 17, the web leaves felt 11 and causes a free stretch 27. Free stretch 27 of the fiber web may be stabilized by conventional blowing or suction devices. After free stretch 27, web 23 may be conveyed around the first additional cylinder 17 by felt 19. Accordingly, the drier group 3 may be arranged for web 23 to meander around additional drier cylinders 17 and drier cylinders. 5*a* and 5*b* such that a bottom side of web 23 may touch an outer surface of drier cylinders 5 and an upper side of web 23 may touch an outer surface of additional drier cylinders 17 to order to warm and dry web 23. Due to the positioning of guide rollers 21*a* and 21*b* which are upwardly displaced from imaginary line 18 and parallel to imaginary line 7, there is a particularly wide loop formed by additional drier cylinders 17. The bearings of the guide rollers 21*a* and 21*b* need an accordingly adapted setting. It may also be contemplated that additional drier cylinders 17 may also be surrounded by felt 11 and, thus, felt 19 may be omitted.

Continuous web 23 and felt 11, after running off drier cylinder 5*b* in the transport direction, may be directed to a subsequent drier cylinder 5 via guide roller 9. The web may then complete its run through drier section 1 by winding around the subsequent drier cylinder 5 of single-row drier group 3, which is also equipped with single felt 11.

Figure 2:
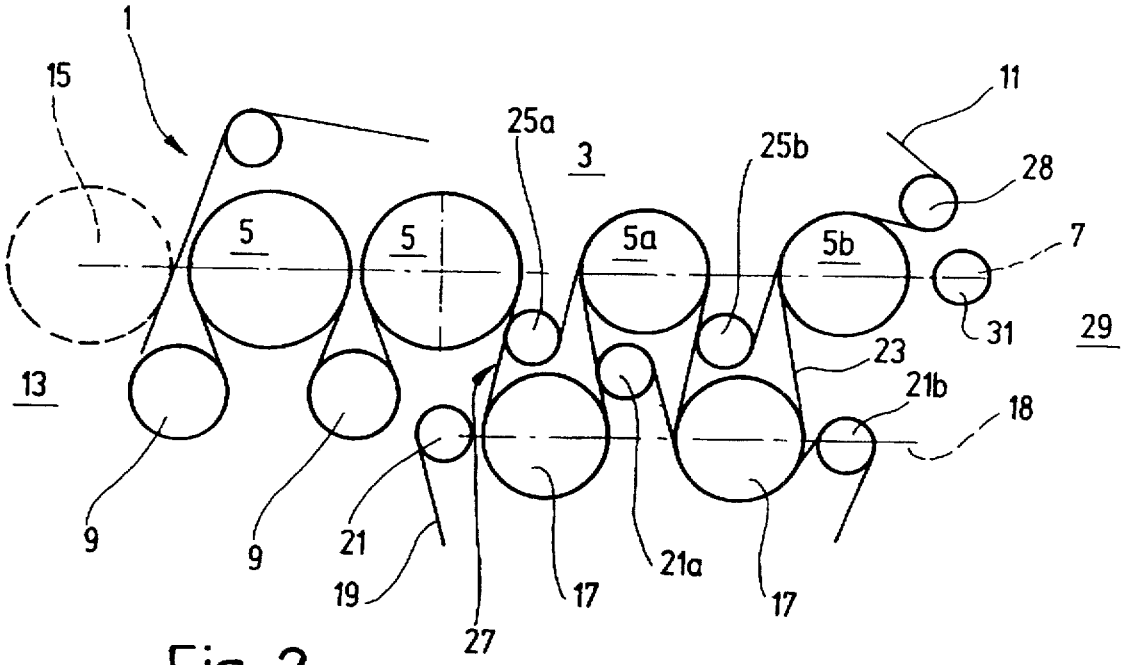
FIG. 2 shows a side view of an alternative arrangement of the exemplary embodiment of the drier section.

FIG. 2 shows a variation of the exemplary embodiment shown in FIG. 1. In FIG. 2, same parts are indicated by the same reference numbers so that reference can be made to the description of FIG. 1.

According to the alternative embodiment of FIG. 2, the schematic side view shows that felt 11 is led from drier cylinder 5*b* over a suitable guide roller 28 and led back toward the first drier cylinder 5 of the drier group 3 Additional drier cylinders 17 may be arranged at an end, i.e., with respect to the transport direction, of drier group 3. The last two drier cylinders, i.e., 5*a* and 5*b*, may have a smaller diameter than the two first drier cylinders 5 of drier group 3. For example, the diameter of drier cylinders 5*a* and 5*b* may correspond to the diameter of the additional drier cylinders 17. In a variation to the embodiment shown in FIG. 1, center axes of the first and last additional guide rollers, i.e., 21 and 21*b* assigned to the additional drier cylinders 17 for guiding felt 19, may be arranged in a single plane with the center axes of the additional drier cylinders 17. Thus, the additional guide rollers 21 and 21*b* may be also arranged along imaginary line 7. This virtual pull-down arrangement of last additional guide roller 21*b* may reduce the degree of looping for the web 23 in the area of the additional drier cylinder 17. Further, the construction for setting the additional drier cylinders 17 and the additional guide rollers 21, 21*a* and 21*b* may be simplified.

Drier group 3 may be followed by a subsequent group, e.g., another drier group or any other downstream paper processing or upgrading device indicated as 29. For the purpose of illustration, only a guide roller 31 of subsequent group 29 is shown here. It may also be possible that drier group 3 may be preceded by an earlier drier group 13. For the purpose of illustration, only a final drier cylinder 15 is shown here (in broken lines). The center axis of final drier cylinder 15 and the center axis of the guide roller 31 may be arranged along imaginary line 7 to provide a particularly simple setting for the present invention.

The variations of the embodiments discussed in accordance with FIGS. 1 and 2 share the feature that additional guide rollers 21, 21*a* and 21*b*, and guide rollers 25*a* and 25*b* have a diameter smaller than the diameter of guide roller 9. However, the diameters of additional guide rollers 21, 21*a*, and 21*b* and guide rollers 25*a* and 25*b* may have a substantially equivalent diameter. As such, a simpler construction of drier section 1 may be achieved.

Figure 3:
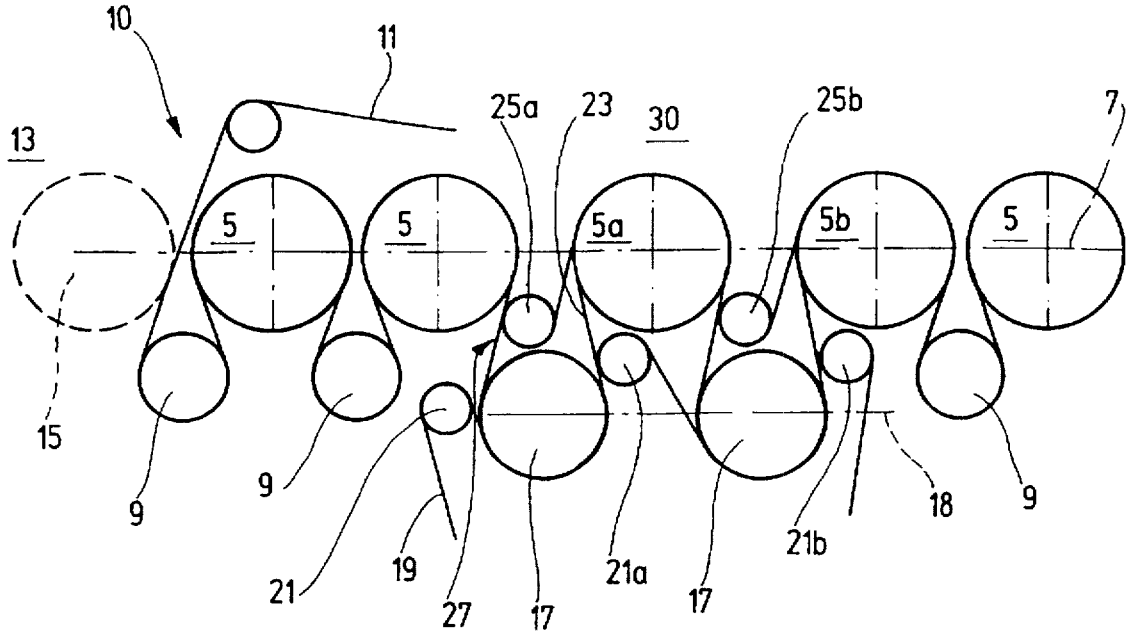
FIG. 3 shows a side view of an alternative embodiment of the drier section according to the present invention.
Figure 4:
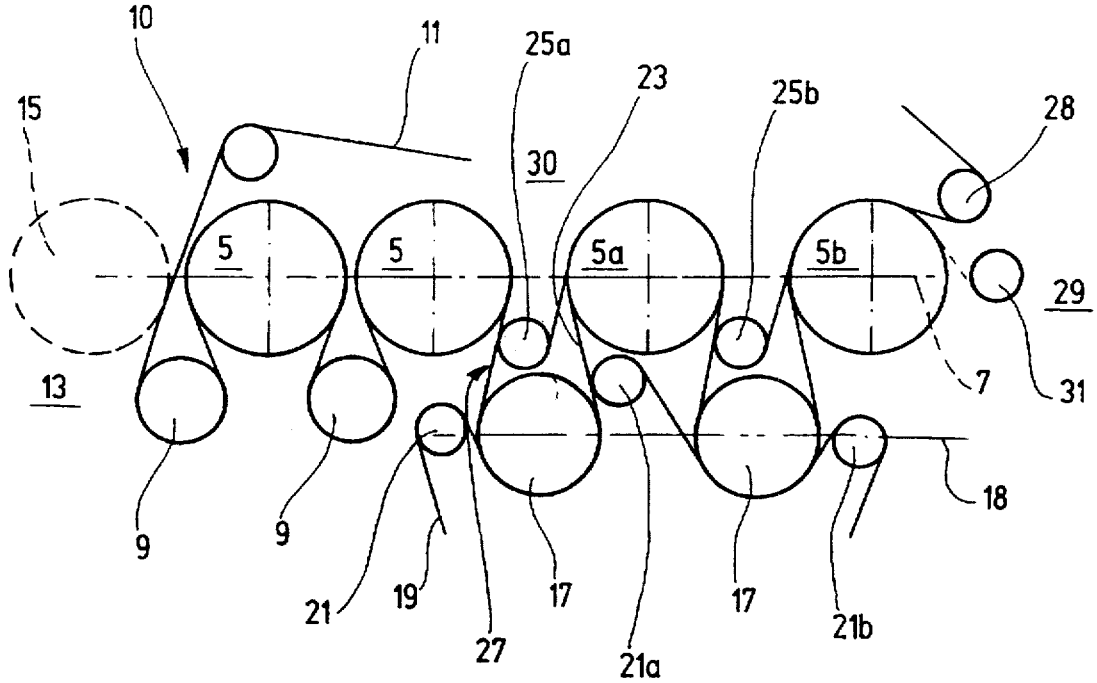
FIG. 4 shows a side view of an alternative arrangement of the alternative embodiment of the drier section.

FIGS. 3 and 4 show an alternative embodiment of the present invention where the drier section may be designated as reference numeral 10. FIG. 3 shows the alternative embodiment and FIG. 4 shows a second variation of the alternative embodiment. The embodiment (and variation thereof) depicted in FIGS. 3 and 4 essentially correspond to those shown in FIGS. 1 and 2, such that same reference numbers have been used to designate the same parts. However, in contrast to the embodiment shown in FIGS. 1 and 2, the alternative embodiments of FIGS. 3 and 4 may include drier cylinders 5, 5*a*, and 5*b* of drier group 30 each having a same diameter and additional drier cylinders 17 having a diameter smaller than the diameter of drier cylinders 5, 5*a*, and 5*b*.

In the embodiment depicted in FIG. 3, additional drier cylinders 17 may be arranged in approximately a center of drier group 30. However, in the alternative depicted in FIG.

4, additional drier cylinders 17 may be arranged at an end, with respect to the transport direction, of drier group 30.

Each of the embodiments and variations shown share the feature that the specific number of additional drier cylinders 17 may be less than the number of drier cylinders 5 of drier groups 3 or 30, however, the illustrations are not intended as a limitation of the present invention. Depending on the size of drier group 3 or 30, for example, between approximately one and four additional drier cylinders 17 may be provided. Preferably, additional drier cylinders 17 may be planned for a drier area of drier section 3 or 30, i.e., near the center of drier group 3 or 30, or at the end of the single felt drier group 3 or 30. However, it is also contemplated that additional drier cylinders 17 may be positioned at a beginning, with respect to the transport direction, of a single-row drier group 3 or 30. It is also contemplated that drier group 3 or 30 may be preceded by at least one more group of additional drier cylinders.

Guide rollers 9, 25*a*, and 25*b* may be constructed as suction guide rollers or as grooved or drilled rollers with external suction devices/suction boxes, although it is not necessary that each guide roller include such devices. The two cylinder rows, i.e., drier cylinders 5 (including drier cylinders 5*a* and 5*b*) of drier group 3 or 30 and additional drier cylinders 17 may be differently heated in order to affect the curl of web 23 to be dried. It may be contemplated that a device for moistening fiber web 23 for effecting curl may be included.

In the accompanying drawings, only one group of additional drier cylinders 17 has been shown. However, the present invention contemplates that it is possible to arrange for two or more groups of additional drier cylinders 17 in order to affect the curl of the web to be dried.

As can be seen from each of the accompanying figures, the present invention may save construction space by selecting smaller drier cylinders 5*a* and 5*b* of the drier group 3. This space savings may be used for other built-ins. Each of the embodiments and variation shown in FIGS. 1, 2, 3, and 4 may be situated within similar systems or settings because the distances between the center axes of each two embodiment, measured at perpendicular to a lengthwise extension, are the substantially the same. However, due to the larger drier cylinders 5*a* and 5*b* utilized in drier group 30 more space is required, at least in the lengthwise direction, for the embodiment of FIGS. 3 and 4.

In accordance with the present invention, it is seen that the curl of fiber web 23 to be dried may be influenced within a drier section 3 or 30 in a simple manner. The present invention does not require double-felt groups joined after a single-felt drier group. Thus, construction expenses may be considerably lower than for conventional drier sections shown in the prior art. In addition, the number of felt pieces used can be reduced, which leads to further cost reductions.

By arranging additional drier cylinders 17 near the center area or towards the end of the drier section 3 or 30, it is possible to exert various influences on the curl of web 23 without changing the construction expenses or the number of felt belts used. According to the present invention, the curl behavior of a web to be dried may be individually influenced without increasing the expense of realization of the drier sections.

The present invention has been described as a drier section within a paper production machine. However, such a drier section may be used for drying a running web in which the curl is to be subjected to targeted influences.

The foregoing description of the present invention makes it clear that drier section 3 or 30 does not deviate from the basic principle of the single-row drier group with a corresponding drying felt. However, in a relatively short section of the single-row drier group, in which the web has already passed through at least a portion of the drying process, the web may be dried on opposite sides by the additional drier cylinders and the drier cylinders of the drier group. By the short-time drying of the opposite side of the web and by the defined free stretches during the transition from the drier cylinders 5 to the additional drier cylinders 17, the curl of the web may be influenced in a targeted manner. Accordingly, the arrangement of additional drier cylinders 17 within the single-row drier group 3 or 30, the distances between the center axes of the additional drier cylinders 17 (i.e., imaginary line 18) and the center axes of drier cylinders 5, 5*a*, and 5*b* of the drier group 3 or 30 (i.e., imaginary line 7), and the free stretches 27 of the paper web 23 may be defined by a transition from the drier cylinders of the drier group to the additional drier cylinders. Depending on the arrangement of the guide rollers 21, 21*a* and particularly 21*b*, which are assigned to the additional drier cylinders, the free stretches and, thus, their curl, can be influenced.

In the descriptions for FIGS. 1 to 4, the single-row drier group has been described, for the purpose of illustration only, as including upper drier cylinders. However, it is also possible that the additional drier cylinders may be used in connection with a drier group that uses lower drier cylinders.

The design of the drier groups within a drier section that may contain several drier groups can be varied as desired. It is also possible to assign additional drier cylinders to only one of these drier groups or to provide several drier groups with additional drier cylinders. Depending on the curl behavior of the web running across the drier cylinders of the drier section, it can also be provided that the additional drier cylinders are assigned to one or several defined drier groups within the drier section.

Finally, the additional drier cylinders may be arranged in such a manner that they extend across a border section of two adjoining drier groups so that the additional drier cylinders may be assigned to the end section of one drier group and the starting section of the subsequent drier group.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A drier section for drying a continuous web, the drier section comprising:

at least one single-row drier group including a plurality of drier cylinders, a plurality of guide rollers, and a continuous felt belt;

the continuous felt belt guided around the plurality of drier cylinders and the plurality of guide rollers;

an additional drier section including a plurality of additional drier cylinders, a plurality of additional guide rollers, the plurality of additional drier cylinders being less in number than the plurality of drier cylinders, the plurality of additional drier cylinders having a diameter less than a diameter of the plurality of drier cylinders; and the continuous web guided in a meandering manner around the plurality of drier cylinders and around the plurality of additional drier cylinders.

2. The drier section according to claim 1, the plurality of additional drier cylinders comprising between one and four drier cylinders.

3. The drier section according to claim 1, the plurality of additional drier cylinders being one or two drier cylinders less than the plurality of drier cylinders.

4. The drier section according to claim 1, a portion of the plurality of drier cylinders arranged adjacent to the plurality of additional drier cylinders comprising a diameter less than the diameter of a remaining portion of the plurality of drier cylinders.

5. The drier section according to claim 4, the diameter of the portion of drier cylinders is substantially similar to a diameter of the plurality of additional drier cylinders.

6. The drier section according to claim 1, a portion of the plurality of guide rollers are arranged adjacent to the plurality of additional drier cylinders, and the portion of guide rollers arranged parallel to the plurality of drier cylinders.

7. The drier section according to claim 1, the plurality of additional drier cylinders are positioned within one of a center area and an end section, with respect to a transport direction of the continuous web, of the single-row drier group.

8. The drier section according to claim 1, the continuous felt belt guided around the plurality of drier cylinders and around the plurality of additional drier cylinders.

9. The drier section according to claim 1, further comprising at least two additional drier cylinder groups, each of the at least two additional drier cylinder groups including a separate felt.

10. The drier section according to claim 9, the at least two additional drier cylinder groups are associated with two adjacent single-row drier groups and positioned within a border area between the two adjacent single-row drier groups.

11. The drier section according to claim 1, the single-row drier group comprising upper drier cylinders.

12. The drier section according to claim 1, the single-row drier group comprising lower drier cylinders.

13. The drier section according to claim 1, further comprising a plurality of single-row drier groups, at least one of the single-row drier groups comprising a plurality of additional drier cylinders.

14. The drier section according to claim 13, the single-row drier group comprising the additional drier cylinders positioned at one of a center and an end, with respect to a transport direction of the web, of the plurality of single-row drier groups.

15. The drier section according to claim 1, the continuous web comprising a paper web produced by a paper manufacturing machine.

16. The drier section according to claim 1, the plurality of additional drier cylinders comprising one of two and three drier cylinders.

17. A drier section for drying a continuous web, said drier section comprising:

a single row drier group comprising a plurality of first drier cylinders colinearly arranged;

a double row drier group comprising a plurality of second drier cylinders colinearly arranged, said plurality of first drier cylinders and said plurality of second drier cylinders parallely arranged, the plurality of second drier cylinders having a diameter less than a diameter of the plurality of first drier cylinders; and a plurality of guide rollers guiding the continuous web around each drier cylinder in said first and second plurality of drier cylinders.

18. The drier section according to claim 17, the plurality of guide rollers comprising a first set of guide rollers associated with the plurality of first drier cylinders and a second set of guide rollers associated with the plurality of second drier cylinders.

19. The drier section according to claim 18, further comprising a first continuous felt member arranged around each of said plurality of first drier cylinders and around each of said first set of guide rollers, and a second continuous felt member arranged around each of said plurality of second drier cylinders and around each of said second set of guide rollers.

20. The drier section according to claim 18, further comprising a continuous felt member arranged around each of said plurality of first drier cylinders and of said plurality of second drier cylinders.

21. The drier section according to claim 17, said plurality of second drier cylinders positioned adjacent an approximate middle portion of said plurality of first drier cylinders.

22. The drier section according to claim 17, said plurality of second drier cylinders positioned adjacent an end portion, with respect to a transport direction of the continuous web, of said plurality of first drier cylinders.

23. The drier section according to claim 17, each of said plurality of first drier cylinders comprising a first diameter and each of said plurality of second drier cylinders comprising a second diameter, said first diameter being greater than said second diameter.

24. The drier section according to claim 17, said plurality of first drier cylinders comprising an adjacent portion positioned adjacent to the plurality of second drier cylinders and a remaining portion including the first drier cylinders not positioned adjacent to the plurality of second drier cylinders.

25. The drier section according to claim 24, said first drier cylinders of said adjacent portion comprising a first diameter and said first drier cylinders of said remaining portion comprising a second diameter, said first diameter being less than said second diameter.

26. The drier section according to claim 25, said plurality of second drier cylinders comprising a third diameter, said third diameter being substantially similar to said first diameter.

27. The drier section according to claim 17, a total of said plurality of second drier cylinders being less than a total of said plurality of first drier cylinders.

28. The drier section according to claim 17, said first set of guide rollers comprising an adjacent guide portion positioned adjacent said plurality of second drier cylinders and a remaining guide portion comprising said first set of guide rollers not adjacent to said second drier cylinders.

29. The drier section according to claim 28, said guide rollers of said remaining guide portion colinearly arranged parallel to said plurality of first drier cylinders.

30. The drier section according to claim 18, at least one of said guide rollers of said second set of guide rollers colinearly arranged with said plurality of second drier cylinders.

* * * * *